US005315281A

United States Patent [19]

Mount

[11] Patent Number: 5,315,281

[45] Date of Patent: May 24, 1994

[54] THERMOSTATICALLY CONTROLLED SWITCH

[75] Inventor: Mason B. Mount, Mansfield, Ohio

[73] Assignee: TPI Corporation, Gray, Tenn.

[21] Appl. No.: 124,888

[22] Filed: Sep. 21, 1993

Related U.S. Application Data

[63] Continuation of Ser. No. 977,576, Nov. 17, 1992, which is a continuation-in-part of Ser. No. 841,592, Feb. 25, 1992, Pat. No. 5,173,679.

[51] Int. Cl.[5] ..... H01H 37/12; H01H 37/36

[52] U.S. Cl. ..... 337/319; 337/312; 337/323

[58] Field of Search ..... 337/312, 313, 314, 315, 337/316, 317, 318, 319, 320, 321, 322, 323, 114, 115, 116, 117, 118, 119, 121; 200/83 R, 83 P, 83 S, 83 SA, 83 W, 83 Z

[56] References Cited

U.S. PATENT DOCUMENTS

| | | | |
|---|---|---|---|
| 3,114,813 | 12/1963 | Durst . | |
| 3,226,512 | 12/1965 | Durst et al. . | |
| 4,510,480 | 4/1985 | Rossi et al. | 337/321 |
| 4,626,819 | 12/1986 | Drapeau | 337/323 |
| 5,101,189 | 3/1992 | Dolza et al. | 337/319 |

*Primary Examiner*—Harold Broome

*Attorney, Agent, or Firm*—Fay, Sharpe, Beall, Fagan, Minnich & McKee

[57] ABSTRACT

A housing (10), (54) defines a well which holds a diaphragm assembly (12). The diaphragm assembly has a stud portion (14) that extends through an aperture in the housing and is biased into the housing by a spring (16). The stud portion defines a channel (18) which is received in a slot between arms of a calibration plate (20). Movement of the calibration plate transverse to the axis of the stud portion engages a cam surface (24) to position the diaphragm, more particularly a dielectric button (34) which engages a switch control member (50). As a fluid in a bulb (32) expands, it causes the diaphragm to expand, moving the control member (50) and one end of control spring portion (48) causing contacts (46, 52) to open. When the temperature of the bulb reaches the temperature set by the calibration plate, the control spring portion flexes opening the contacts. To reset the switch and close the contacts, a reset member (92) is depressed. A coil spring (94) limits the reset pressure such that the switch can only be reset or closed when the sensed temperature drops sufficiently. An emergency shut off member (100) engages the spring blade member (44) directly opening the contacts without regard to the sensed temperature. In a fixed temperature embodiment (FIG. 5), a pivot member (110) defines the flex point of spring blade member to determine whether the switch works in a snap acting mode or a slow make/break mode.

23 Claims, 5 Drawing Sheets

THERMOSTATICALLY CONTROLLED SWITCH

This application is a continuation of U.S. patent application Ser. No. 07/977,576, filed Nov. 17, 1992, now abandoned, which is a continuation-in-part of U.S. patent application Ser. No. 07/841,592, filed Feb. 25, 1992, now U.S. Pat. No. 5,173,679.

BACKGROUND OF THE INVENTION

The present invention relates to controllable switches. It finds particular application in conjunction with capillary thermostat controlled switches for electric and gas ovens, and will be described with particular reference thereto. However, it is to be appreciated that the present invention will also find application in other thermostatic and pressure controls for use not only in home appliances, but also in industrial applications and the like.

Heretofore, range controls, i.e. thermostatic controls for the oven of a range, included a shaft adapted to receive the knob with which the consumer set the temperature of the oven. The shaft was commonly threadedly received in a metal mounting bracket such that rotation of the knob caused the shaft to travel longitudinally. Longitudinal movement of the shaft changed the bias, the mechanical advantage, or a neutral position of a lever arrangement. A bulb was positioned in the oven and connected by a capillary tube with a diaphragm that was also mounted to the bracket of the range control. As the bulb changed temperature, its contained air or other fluid expanded extending the diaphragm. The diaphragm extension interacted with the lever arrangement pivoting the lever to cause an electrical switch to change states. The electrical switch for an electric range was snap acting to permit higher current flows; whereas, for a gas oven, the switch was slow acting for more accurate temperature response at the expense of lower current carrying capacity.

One of the drawbacks of the prior art range controls resided in the difficulty and expense for calibration mechanisms. Temperature calibration was commonly adjusted by turning a threaded member in a threaded bore to adjust the rest position of the diaphragm. First, the pressure of the screwdriver or other tool on the threaded member added a temperature offset to the final calibration. Moreover, even with as many as 80 threads per inch, the amount of movement of the diaphragm assembly for calibration purposes was so small that a lever ratio of about 1:1 or at best 1.5:1 could be achieved. This low lever ratio limited the accuracy of the calibration.

Additional calibrations to the electrical switch, the shaft, and other parts of the control were also done with threaded members received in threaded bores. The cost of the threaded adjustment mechanisms was relatively high.

Another disadvantage of these prior art range controllers was that the threaded engagement of the shaft and bracket fixed the temperature adjustment. Each model required a different threaded shaft and bracket arrangement to accommodate different amounts of travel for different temperature ranges.

Another disadvantage of the prior art range controllers resided in the differing requirements for electric and gas ranges. A different electrical switch and actuator lever arrangement was required for the snap action of the electric range than for the slow acting switch of the gas range. This increased the necessary parts, inventory, and tooling requirements.

Another drawback of the prior art range controls resided in their cost. The prior art controls required numerous threaded members and mating threaded bores for temperature adjustment and calibration, all relatively expensive parts. The prior art range controllers also included numerous elements, such as the actuator lever assembly, which increased complexity and manufacturing cost. The additional parts, complexity, and calibration complexity required additional assembly operations, calibration checks, and the like.

The present invention contemplates a new and improved thermostatically or pressure actuated controller which overcomes the above-referenced problems and others.

SUMMARY OF THE INVENTION

In accordance with the present invention, a temperature controlled switch assembly is provided. A sealed bulb is connected by a tube with a diaphragm assembly such that as a temperature of the bulb changes, a fluid contained therein expands and contracts flexing a diaphragm of the diaphragm assembly. The diaphragm assembly is mounted in a housing. An electrically conductive spring blade member has an elongated spring portion and a control spring portion. The spring blade member is mounted to a housing adjacent one end thereof and has at least a first electrical contact mounted adjacent a second end thereof. A control member is connected between the diaphragm and the control spring portion such that movement of the diaphragm causes the elongated spring portion second end and first electrical contact to move between first and second positions. A stationary contact is engaged by the first electrical contact at the first position. A reset member selectively applies an urging force to the control member which urging force urges the control member to cause the elongated spring portion second end and the first electrical contact to move to the first position. A force limiting means is connected between the reset member and the control member for limiting the urging force.

In accordance with a more limited aspect of the present invention, the force limiting means is a coil spring.

In accordance with another aspect of the present invention, a switch assembly is provided. An electrically conductive spring blade member has an elongated spring portion and a control spring portion. The spring blade member is mounted to the housing adjacent one end thereof and has at least a first electrical contact mounted adjacent a second end thereof. A stationary electrical contact is disposed adjacent the first electrical contact for selective electrical connection therewith. A control member is connected between a diaphragm and the control spring portion. Movement of the diaphragm causes movement of the elongated spring portion second end such that the first and second electrical contacts move between open and closed positions. An emergency member mechanically is connected with the elongated spring portion to move the first and second contacts to the open position regardless of the position of the control member and the diaphragm.

In accordance with another aspect of the present invention, a fluid controlled switch assembly is provided. A diaphragm assembly including a diaphragm and diaphragm stud is received in a well in a first housing portion with the stud extending through an aperture in the first housing portion. A calibration means adjustably moves the diaphragm stud axially in the housing aperture. An electrically conductive spring blade member has an elongated spring portion and a control spring portion. The spring blade member is mounted to the first housing portion adjacent one end of the spring member. A control member is connected with the control spring portion. The control member is operatively connected with the diaphragm such that the connecting spring portion is moved with movement of the diaphragm. A stationary electrical contact is supported by one of the housing portions. The elongated spring portion supports an electrical contact on a free end thereof for selectively making and breaking electrical contact with the stationary electrical contact in response to movement of the control member. A second housing portion closes the first housing portion well. The second housing portion integrally defines a member which abuts the elongated spring portion adjacent the control member to control whether the spring portion snaps the spring mounted electrical contact into and out of electrical contact with the stationary electrical contact.

In accordance with another aspect of the present invention, a fluid controlled switch assembly is provided. A diaphragm assembly includes a diaphragm and diaphragm stud received in a well in the first housing portion with the stud extending through an aperture in the first housing portion. A calibration means adjustably moves the diaphragm stud axially in the housing aperture. An electrically conductive spring blade member has an elongated spring portion and a control spring portion. The spring blade member is mounted to the first housing portion adjacent one end of the spring member A control member is connected with the control spring portion. The control member is operatively connected with the diaphragm such that the connecting spring portion is moved with movement of the diaphragm. The spring portion has first and second spring electrical contact portions mounted on opposite sides thereof. A first stationary electrical contact is supported by the housing opposite the first spring electrical contact portion for making and breaking electrical contact therewith in response to movement of the control member. A second stationary electrical contact supported by the housing opposite the second spring electrical contact portion makes and breaks electrical contact therewith in response to movement of the control member.

In accordance with another aspect of the present invention, a pivot point at which the spring blade member flexes is selectable such that the spring blade member functions as (1) an over-center, snap-acting switch or (2) a slow make/break control.

In accordance with another aspect of the present invention, the diaphragm assembly includes an axially extending stud which extends through a wall of the housing. The stud defines track which slidably receives a calibration member. The calibration member slides transversely relative to the axis of the stud. A cam surface is disposed on the housing adjacent and engaging the calibration member such that the sliding motion of the calibration member cams the diaphragm stud, hence the diaphragm closer and further from the electrically conductive blade. The combination of the cam and screw threads in the manufacturing fixture permit a 256:1 gain or better in calibration.

One advantage of the present invention is that it prevents manual reset until a safe temperature or other sensed condition is present.

Another advantage of the present invention is that it is quickly and accurately assembled with a minimum of labor.

Another advantage of the present invention resides in its simplicity.

Another advantage of the present invention is that it can be configured as either a snap-acting or a slow make/break control by changing only a small dielectric member.

Another advantage of the present invention is that the diaphragm assembly is easier to mount and more accurately calibratable.

Other advantages of the present invention include fewer parts, simplified manufacturing and calibration, and lower cost.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
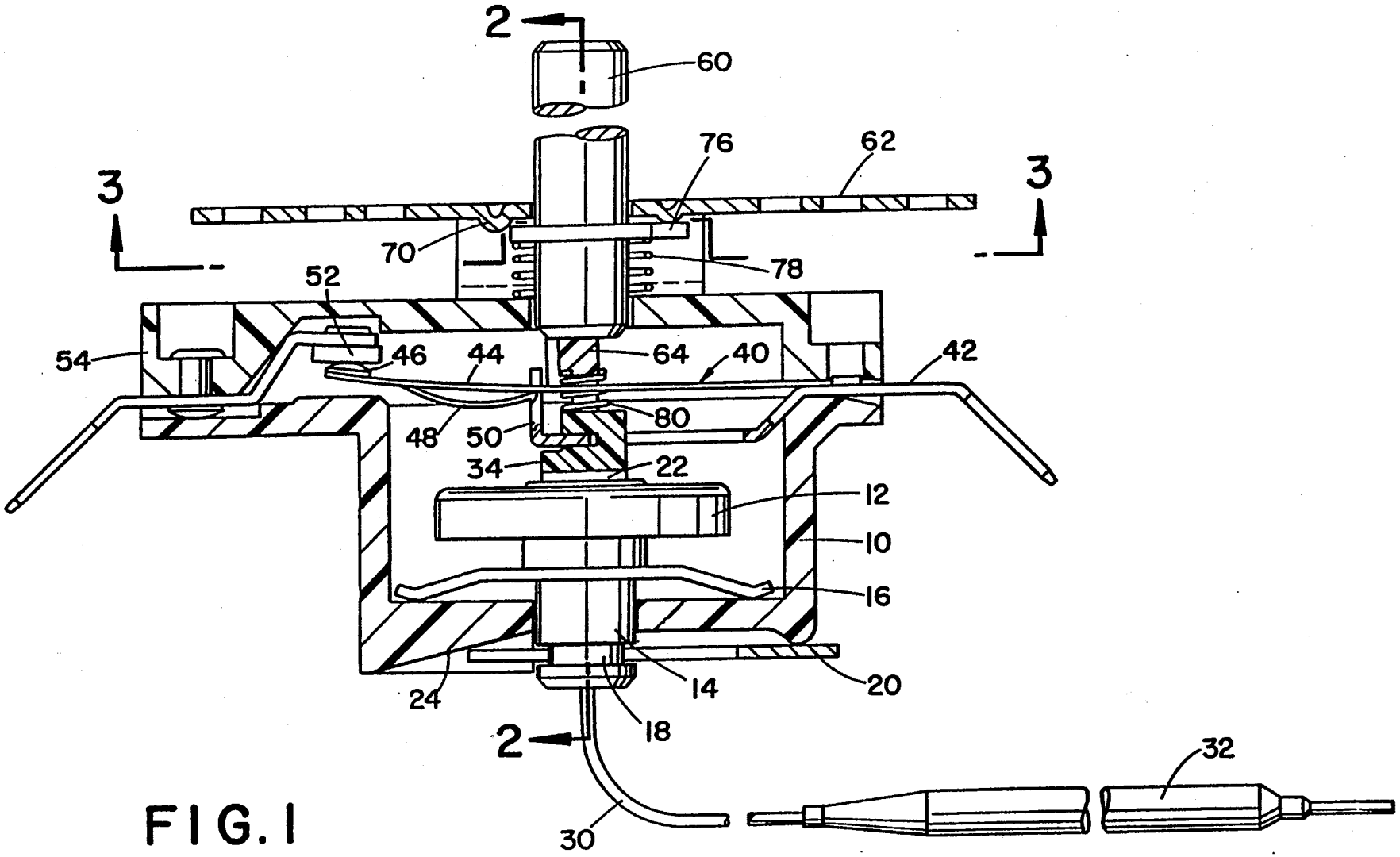
FIG. 1 is a side view in partial section of a snap acting control switch assembly in accordance with the present invention.
Figure 2:
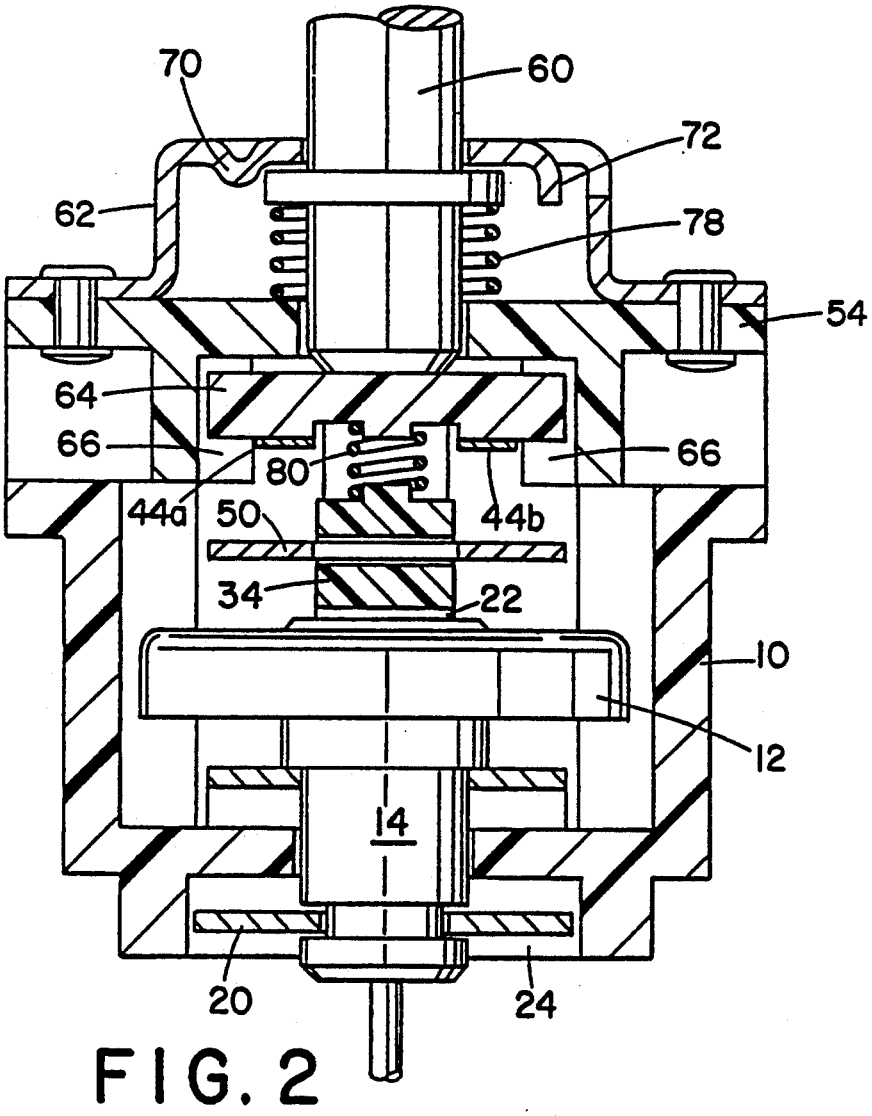
FIG. 2 is an end view in partial section through section 2—2 of FIG. 1.

With reference to FIGS. 1 and 2, a lower dielectric housing portion 10 defines an interior well in which a diaphragm assembly 12 is received. The diaphragm assembly includes a stud portion 14 which extends through a stiff compression spring 16 and an aperture in a bottom wall of the lower housing portion 10. The stud member defines a channel, preferably circumferential groove 18, which slidably receives tines or arms of a calibration member or plate 20. The calibration plate 20 and the spring 16 precisely position the diaphragm assembly, hence an upper surface diaphragm 22 relative to the lower body portion 10. A cam surface 24 is defined on a lower face of the lower housing portion to engage one end of the calibration plate 20. By shifting the calibration plate transversely to the axis of the stud 14, the position of the diaphragm 22, hence the calibration of the control are selectively adjustable.

A capillary tube 30 extends from the diaphragm assembly 12 to a bulb 32. As the bulb is heated, the fluid inside expands, causing the diaphragm to flex upward (in the orientation of FIGS. 1 and 2). The outer surface of the diaphragm carries a dielectric member or button 34 which engages an electrically conductive switch blade assembly 40.

The electrically conductive blade assembly 40 includes a support and terminal 42 to which a spring or blade member 44 is mounted. The spring member includes a pair of spring segments 44*a* and 44*b* which extend to either side of the diaphragm button 34 defining a central aperture and which converge adjacent a movable electrical contact 46. The spring member also defines a control spring portion 48 which extends under compression between the movable electrical contact 46 and a movable control member 50. The movable control member 50 is received in a slot in the button 34 to be moved with the diaphragm 22. The control spring portion 45 amplifies movement of the button causing the electrical contact 46 to snap over-center into and out of contact with a stationary electrical contact 52. The stationary electrical contact 52 is riveted to an upper housing portion 54. The movable blade assembly 40 is clamped between the upper housing portion 54 and the lower housing portion 10.

The temperature at which the contacts 46, 52 make and break is adjusted by adjusting the flexing or bias on the spring blade 44. A shaft 60 is movably received through a bore in a mounting bracket 65 and a bore in the upper housing portion 54. The shaft 60 engages a dielectric member or actuator 64 which is received in a track 66 and engages the spring member 44. The actuator 64 is constructed of a dielectric material to insulate the shaft 60 from the electrical conduction path. By selectively moving the shaft 60 axially, a bias on and neutral flex position of the spring member 44 is adjusted which changes the degree of axial extension of diaphragm which causes the contacts 46, 52 to make/-break.

Figure 3:
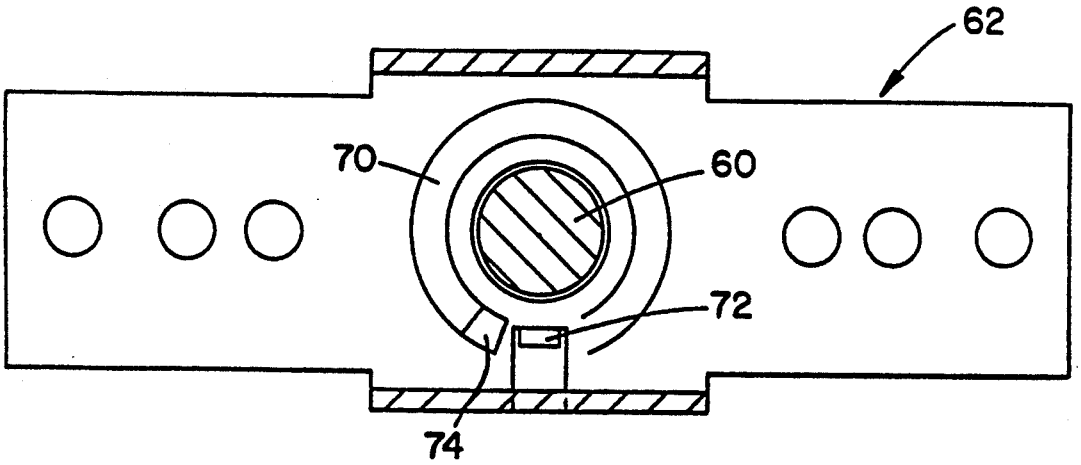
FIG. 3 is a detailed view in partial section along section 3—3 of FIG. 1.

With reference to FIG. 3, the mounting bracket 62 has a cam surface 70 stamped therein. The cam surface has its least projection or camming action adjacent a stop 72 which is folded down from the mounting bracket 65. The height of the cam surface, hence the degree of camming action increases circumferentially around the shaft 60. Just before the stop 72 at the high end, the circumferential cam surface 70 defines a notch or lower cam region 74. The shaft 60 carries a cam follower 76 which is biased firmly against the cam surface 70 by a spring 78 or other biasing means. As the shaft is rotated, the cam follower follows the cam surface causing the shaft 60 and actuator 64 to move longitudinally toward the diaphragm 22.

In a gas range, the spring 75 biases the cam follower 76 into the notch 74 at a low temperature limit of rotation locking the shaft against rotation. To increase the temperature setting, the stem is depressed against the action of spring 78 lifting the cam follower 76 out of the notch 74 allowing it to rotate along the cam surface 70.

A spring 80 is advantageously provided between the actuator 64 and the diaphragm button 34 for biasing the diaphragm. This assures that the diaphragm retracts as the pressure in the capillary tube drops.

In the electric range embodiment, the actuator 64 contacts the spring blade 44 behind the control member 50. This places the blade in an over-center configuration. That is, on one side of a center point, the control spring portion 45 pushes the electrical contact up against the stationary contact 52. On the other side of the center point, the spring portion 45 flexes, pushing the electrical contact 46 down away from the stationary contact. Very small amounts of movement of the diaphragm are required to shift between the over and under center positions, causing the spring to snap between make and break states. As the temperature adjustment shaft 60 is turned and the interaction of cam surface 70 and cam follower 76 moves the actuator 64 further into or out of the housing, the center point is shifted. Hence, the position at which actuator 50 moves between over and under center positions is shifted.

For different models, the cam track 70 is stamped in the bracket 62 with a different degree of pinch. For example, for a temperature controller with a wider range of temperatures, the cam surface can have a greater difference in height between its two extremes. As another option, the cam surface can have a relatively flat pitch at one end of the cam surface for low temperatures, changing to a steeper pitch at the other end for less precise control of a wider range of high temperatures. Other variations in the cam surface such as reverse profiles of the cam are also contemplated.

To perform an initial calibration, the shaft 60 is rotated to an angular orientation corresponding to a preselected temperature. The bulb 32 is heated precisely to the preselected temperature. The calibration plate 20 is shifted until the control member 50 is substantially at the center point such that any decrease in temperature will cause the contacts 46, 52 to make and any increase in temperature will cause the contacts 46, 52 to break Optionally, the calibration procedure may be repeated at several preselected temperatures.

In the preferred embodiment, the calibration plate 20 and the cam surface 24 provide about a 256:1 mechanical gain. Preferably, the lower housing is clamped in a jig which has a threaded shaft extending parallel to the calibration plate. Rotation of the shaft moves a follower that pushes and pulls the calibration plate transverse to the axis of the stud. This provides for very fine positional adjustment of the diaphragm upper surface 22. When the desired calibration is reached, a frangible seal, such as a brittle wax or plastic compound, is applied over at least selected portions of the calibration plate, the diaphragm stud, and the housing bottom wall to provide a visual indication whether there has been tampering with the calibration.

Other calibration mechanisms for shifting the diaphragm assembly axially are also contemplated. For example, the stud can be threaded to receive a nut on the exterior of the housing. Rotation of the nut acting against spring 16 axially positions the diaphragm assembly. In another calibration arrangement, the stud 14 is threaded and engages threads on a lower wall of the lower housing 10. The stud is rotated in the threads to adjust the calibration.

Although described as an over-center, snap-acting actuator, the present invention is equally applicable to slow make/break actuators. In the snap-acting embodiment, the actuator 64 contacts the blade or spring element 44 behind control member 50. By extending or reconfiguring the actuator 64 such that it contacts the blade or spring member in front of control member 50, the over-center operation is defeated and the switch functions in a slow make/break manner.

Figure 4:
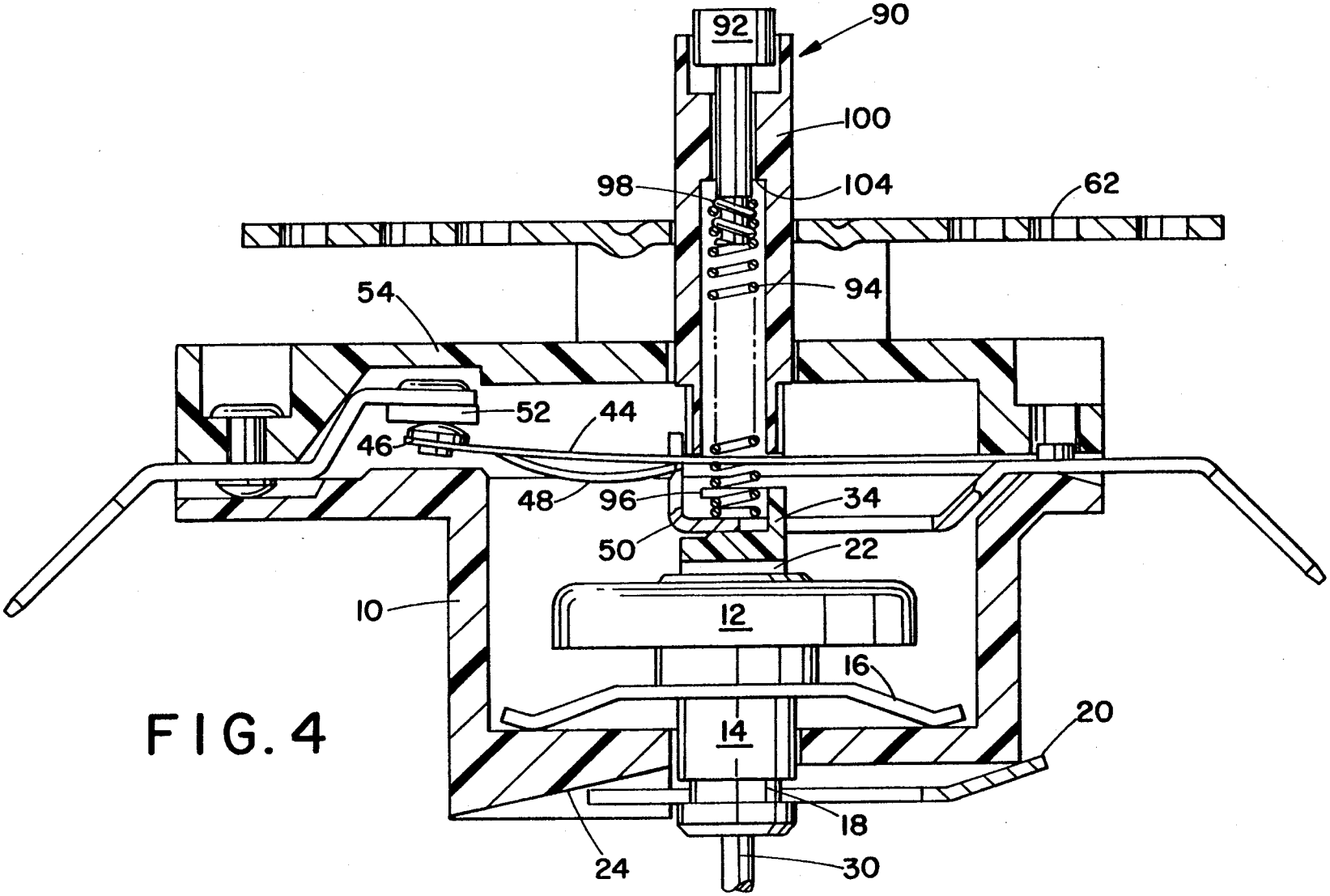
FIG. 4 is a side view in partial section of a manual reset embodiment of the present invention.

In the embodiment of FIG. 4, the switch is manually reset. The calibration plate 20 is initially adjusted or calibrated such that the diaphragm assembly 12 causes contacts 46, 52 to change state, i.e. open, at a preselected temperature or other sensed condition. A reset and emergency shut off assembly 90 is manually actuatable to cause the contacts 46, 52 to change state, particularly to open in the emergency shut off mode and close in the reset mode.

More specifically to the preferred embodiment, once the contacts open, they remain open even as the diaphragm withdraws. The reset means includes a first or reset member 92 which is connected by a spring 94 with the control member 50. In particular, the diaphragm button 34 defines a recess or collar arrangement between partially surrounding arms 96 for holding the spring 94 in contact with the control member 50. The reset member 92 has a threaded inner end 98 for threaded mechanical interconnection with an end of the spring 94.

To reset the switch, the reset member 92 is depressed. The manual depressing force is transmitted through the spring 94 to the control member which rides on the diaphragm 12, urging the control member to reset once the diaphragm has retracted. In this manner, the spring 94 acts as a transmitted force limiting means limiting the amount of mechanical reset force which is transmitted to the control member 50. In the preferred embodiment in which the diaphragm position is controlled by the temperature sensed by the bulb 32, the temperature of the bulb determines the extent to which the diaphragm can be retracted. The spring prevents too much force from being applied manually to the diaphragm and bulb assembly. In this manner, resetting of the switch is prevented unless the sensed temperature is sufficiently low for greater safety.

The assembly 90 further includes a second or emergency shut off member 100 which provides direct mechanical engagement with the spring blade member 44. The direct mechanical pressure on the spring blade member 44 mechanically moves the spring blade member 44 and contact 46. In this manner, the second member 100 provides an emergency override, causing the state to change, i.e. contacts 46, 52 to open, without regard to the sensed temperature or other sensed condition.

The second member 100 includes means for preventing it from being removed from the switch assembly. In the preferred embodiment, this means includes a pair of projecting portions 102 which project rearward and forward in the orientation of FIG. 4 to engage an inner surface of the upper housing portion 54. Optionally, an analogous projection may be provided which engages the bracket 62.

The reset member 92 is preferably held in place by the spring member 94. The spring is frictionally engaged in threads of the reset member at one end and in the locking collar 96 of the button 34 at the other end. Further, the emergency member 100 has a shoulder 104 and a reduced diameter bore above the spring 94. The shoulder 104 prevents the reset member and the spring from being withdrawn from the emergency member 100. Optionally, other arrangements may be provided for preventing the reset member from being removed. For example, the reset member can have a projection which is slidably received through a keyway in the emergency member. After insertion, the reset member is rotated 180° relative to the emergency member to move the key and keyway out of alignment.

Figure 5:
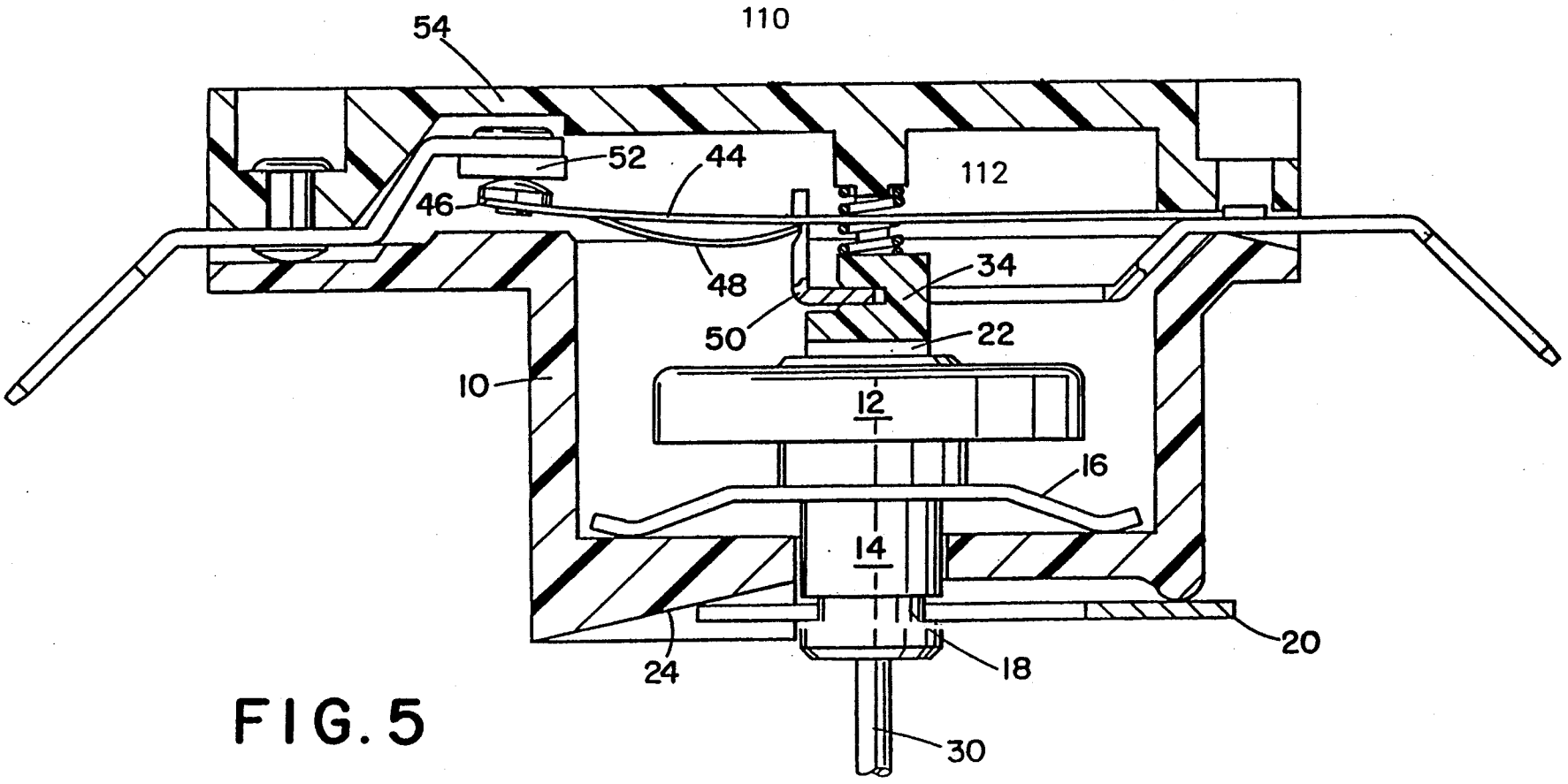
FIG. 5 is a side view in partial section of a fixed set point embodiment of the present invention.
Figure 6:
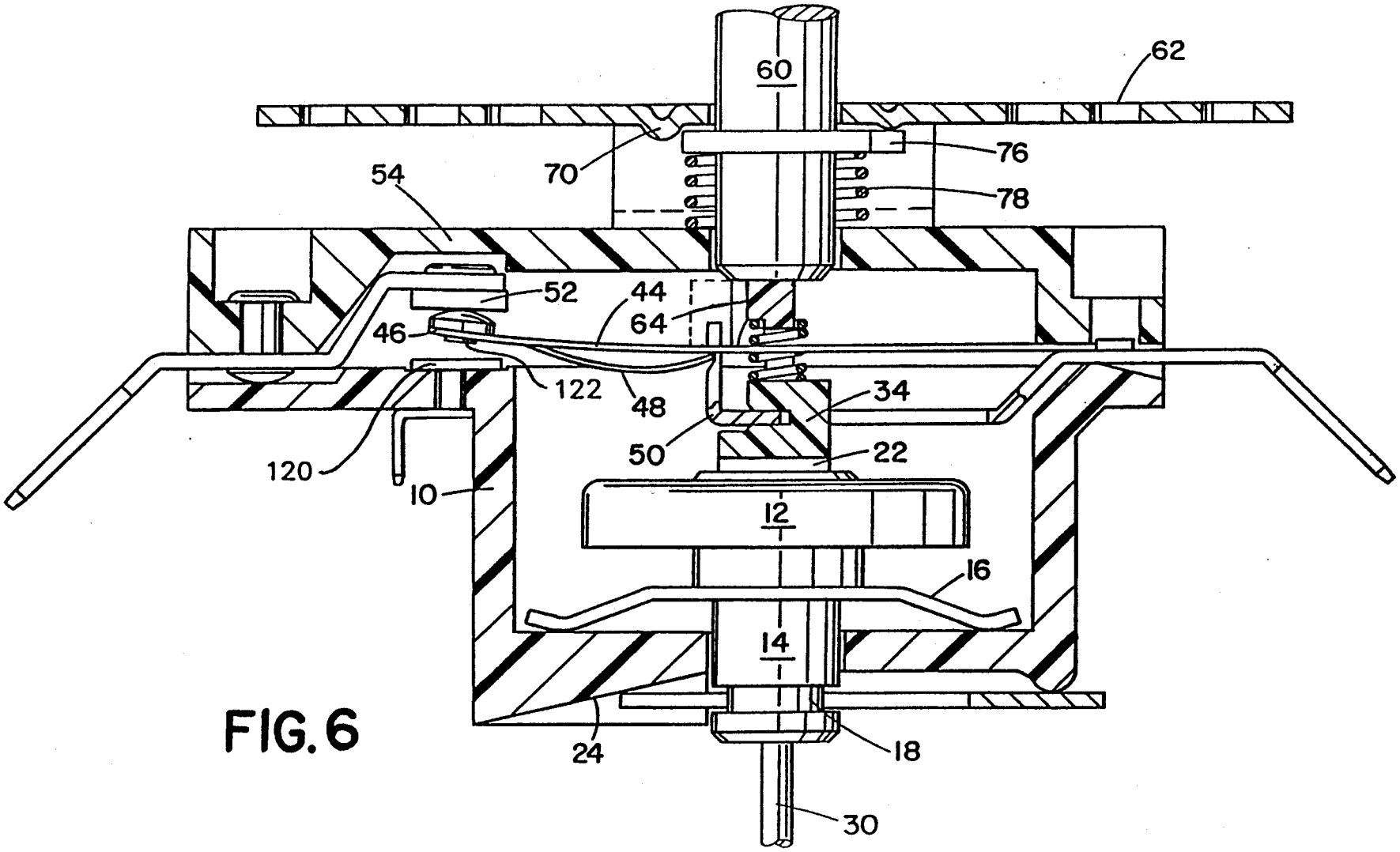
FIG. 6 is a side view in partial section of a double throw embodiment of the present invention.

In the embodiments of FIGS. 5 and 6, common elements with the embodiments of FIGS. 1–4 are denoted by the same reference numerals. In the embodiment of FIG. 5, the temperature set point is set at the factory. A stop and pivot member 110 is integrally molded into a top housing portion 112. In a slow make/break embodiment, the stop and pivot member contacts the spring blade member 42 in front of the control member 50. In a snap-acting embodiment, the stop and pivot member 110 contacts the spring blade member behind the control member. A central detent portion 114 supports a diaphragm return spring 80. The set point of the switch is set by adjusting the calibration plate 20. Once the calibration plate is positioned and sealed, the fixed temperature set point of the switch is set.

In the FIG. 6 double throw embodiment, a second electrical contact 120 is provided opposite to the electrical contact 52. The blade member has a second contact surface 122 opposite to contact 46. In the over-center snap action embodiment, the spring blade 44 snaps contact assembly 46, 122 rapidly between electrical connection with one of contacts 52 and 120. There being no intermediate stable state, the contacts 46, 122 quickly move to either a first state in electrical contact with contact 52 or a second state in contact with electrical contact 120.

Optionally, the actuator 64 may be enlarged as shown in phantom to create a slow make/break embodiment. In the slow make/break embodiment, the contacts 46, 112 move between contacts 52, 110 in proportion to the sensed heat or other monitored condition.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A fluid controlled switch assembly comprising:

a first housing portion;

a diaphragm assembly including a diaphragm and diaphragm stud received in the first housing portion with the stud extending through an aperture in the first housing portion;

a calibration means for adjustably moving the diaphragm stud axially in the housing aperture, the calibration means being connected with the first housing portion and the diaphragm assembly;

an electrically conductive spring blade member having an elongated spring portion and a control spring portion, the spring blade member being mounted to the first housing portion adjacent one end of the spring member and including a control member connected with the control spring portion, the control member being operatively connected with the diaphragm such that the connecting spring portion is moved with movement of the diaphragm;

a stationary electrical contact supported by one of the housing portions, the spring portion supporting an electrical contact on a free end thereof for selectively at least breaking electrical contact with the stationary electrical contact in response to movement of the control member;

a reset means for selectively urging the contacts to close, the reset means being connected with the control member.

2. The assembly as set forth in claim 1 wherein the reset means includes a reset member for selectively applying an urging force to the control member and a force limiting means connected between the reset member and the control member for limiting the urging force.

3. The assembly as set forth in claim 2 further including an emergency shut off member for selectively applying an urging force directly to the spring portion for flexing the spring portion such that the contacts open.

4. The assembly as set forth in claim 1 further including an emergency shut off member for selectively applying an urging force directly to the spring portion for flexing the spring portion such that the contacts open.

5. The assembly as set forth in claim 1 further including a sealed capillary tube and bulb containing a fluid which expands with temperature such that movement of the diaphragm is controlled by a temperature of the bulb.

6. The assembly as set forth in claim 1 further including a second electrical contact portion supported on the spring blade member and a second stationary contact supported by one of the housing portions such that the second electrical contacts make electrical connection when the first electrical contacts break electrical connection.

7. A fluid controlled switch assembly comprising:

a first housing portion;

a diaphragm assembly including a diaphragm and diaphragm stud received in the first housing portion with the stud extending through an aperture in the first housing portion;

a calibration means for adjustably moving the diaphragm stud axially in the housing aperture, the calibration means being connected with the first housing portion and the diaphragm assembly;

an electrically conductive spring blade member having an elongated spring portion and a control spring portion, the spring blade member being mounted to the first housing portion adjacent one end of the spring member and including a control member connected with the control spring portion, the control member being operatively connected with the diaphragm such that the connecting spring portion is moved with movement of the diaphragm;

the spring portion having first and second spring electrical contact portions mounted on opposite sides thereof;

a first stationary electrical contact supported by the housing opposite the first spring electrical contact portion for making and breaking electrical contact therewith in response to movement of the control member;

a second stationary electrical contact supported by the housing opposite the second spring electrical contact portion for making and breaking electrical contact therewith in response to movement of the control member.

8. The assembly as set forth in claim 7 further including an adjustment means which engages the elongated spring member on a surface opposite the diaphragm for adjustably biasing the elongated spring portion.

9. The assembly as set forth in claim 7 further including a sealed capillary tube and bulb containing a fluid which expands with temperature such that movement of the diaphragm is controlled by a temperature of the bulb.

10. The assembly as set forth in claim 7 wherein the calibrating means includes:

a cam surface disposed on an exterior of the first housing portion adjacent the stud aperture;

a sliding member which slidably engages the diaphragm stud and which is mounted for sliding movement transverse to a central axis thereof for controlling axial movement of the diaphragm assembly.

11. The assembly as set forth in claim 7 further including a second housing portion which closes the first housing portion well, the second housing portion integrally defining a member which abuts the spring portion adjacent the control member to cause the first and second spring contact portions do one of (i) snap between the first and second stationary contacts and (ii) move slowly between the first and second stationary contacts with movement of the diaphragm.

12. A fluid controlled switch assembly comprising:

a first housing portion;

a diaphragm assembly including a diaphragm and diaphragm stud received i the first housing portion with the stud extending through an aperture in the first housing portion;

a calibration means for adjustably moving the diaphragm stud axially in the housing aperture, the calibration means being connected with the first housing portion and the diaphragm assembly;

an electrically conductive spring blade member having an elongated spring portion and a control spring portion, the spring blade member being mounted to the first housing portion adjacent one end of the spring member and including a control member connected with the control spring portion, the control member being operatively connected with the diaphragm such that the connecting spring portion is moved with movement of the diaphragm;

a stationary electrical contact supported by one of the housing portions, the elongated spring portion supporting an electrical contact on a free end thereof for selectively making and breaking electrical contact with the stationary electrical contact in response to movement of the control member;

a second housing portion mounted to the first housing portion, the second housing portion integrally defining a member which abuts the elongated spring portion adjacent the control member to control whether the spring portion snaps the spring mounted electrical contact into and out of electrical contact with the stationary electrical contact.

13. The assembly as set forth in claim 12 wherein the second housing portion defines a detent member for supporting one end of a return spring which applies a biasing force to the diaphragm.

14. The assembly as set forth in claim 12 further including a second stationary electrical contact supported by the first housing portion opposite to the first stationary electrical contact such that the spring electrical contact portion is movable between the first and second stationary electrical contacts.

15. A temperature controlled switch assembly comprising:

a sealed bulb connected by a tube with a diaphragm assembly such that as a temperature of the bulb changes, a fluid contained therein expands and contracts flexing a diaphragm of the diaphragm assembly, the diaphragm assembly being mounted in a housing;

an electrically conductive spring blade member having an elongated spring portion and a control spring portion, the spring blade member being mounted to the housing adjacent one end thereof and having at least a first electrical contact mounted adjacent a second end thereof;

a control member connected between the diaphragm and the control spring portion such that movement of the diaphragm causes the elongated spring portion second end and first electrical contact to move between first and second positions;

a stationary second contact which is engaged by the first electrical contact at the first position;

a reset member for selectively applying an urging force to the control member which urging force urges the control member to cause the elongated spring portion second end and the first electrical contact to move to the first position and a force limiting means connected between the reset member and the control member for limiting the urging force.

16. The assembly as set forth in claim 15 further including an emergency member connected with a central portion of the elongated spring portion for applying a biasing force directly thereto, which directly applied biasing force causes the first electrical contact to move to the second position regardless of the temperature sensed by the sealed bulb.

17. The assembly as set forth in claim 15 wherein the control member snaps the first electrical contact between the first and second positions and wherein the force limiting means includes a spring means connected between the reset member and the control member for limiting the urging force such that the urging force can only move the diaphragm and control member sufficiently to snap the spring portion electrical contact to the first position when the bulb member is below a set point temperature.

18. The assembly as set forth in claim 16 wherein the force limiting spring means is a spiral, coil spring and wherein the reset member includes a threaded portion which is threadedly received into the coil spring.

19. The assembly as set forth in claim 18 further including an emergency member connected with a central portion of the elongated spring portion for applying a biasing force directly thereto, which directly applied biasing force causes the first electrical contact to move to the second position regardless of the temperature sensed by the sealed bulb, the emergency member including a central bore therein, the reset member and the coil spring being slidably received in the emergency member central bore.

20. The assembly as set forth in claim 19 wherein the emergency member is slidably received through an aperture in the housing and further including a projecting means which permits sliding movement of the emergency member relative to the housing while preventing the emergency member from being removed from the housing and further including a means for preventing the reset member from being removed from the emergency member central bore.

21. A switch assembly comprising:

an electrically conductive spring blade member having an elongated spring portion and a control spring portion, the spring blade member being mounted adjacent one end thereof and having at least a first electrical contact mounted adjacent a second end thereof;

a stationary second electrical contact disposed adjacent the first electrical contact for selective electrical connection therewith;

a control member connected between a diaphragm and the control spring portion such that movement of the diaphragm causes movement of the elongated spring portion second end such that the first and second electrical contacts move between open and closed positions;

a linearly sliding emergency member in mechanical interconnection with the elongated spring portion such that linearly sliding movement of the emergency member applies force directly on the elongated spring portion which causes the elongated spring portion to flex tripping and retaining the first and second contacts in the open position regardless of the position of the control member and the diaphragm;

a reset means connected with the control member to release the first and second contacts from the tripped, open position allowing the first and second contacts to move to the closed position.

22. The assembly as set forth in claim 21 further including:

a bulb connected by a tube with the diaphragm such that as a temperature of the bulb changes the diaphragm moves moving the control member causing the first and second contacts to move between the open and closed positions;

a spring means connected between the reset means and the control member for transferring a force applied to the reset means to the control member, the spring means limiting the transferred force such that the transferred force can only move the diaphragm and control member sufficiently to move the first and second contacts to the closed position when the bulb member is below a set point temperature;

an emergency member mechanically connected with the elongated spring portion to move the first and second contacts to the open position regardless of the position of the control member and the diaphragm.

23. The assembly as set forth in claim 22 wherein the emergency member and the reset member are mounted in a concentric, slidable relationship.

* * * * *